US007662019B2

(12) United States Patent
Faircloth et al.

(10) Patent No.: US 7,662,019 B2
(45) Date of Patent: Feb. 16, 2010

(54) GARMENT BLANKS, BRASSIERES FORMED THEREFROM AND METHOD OF FORMING THE SAME

(75) Inventors: Michael Faircloth, Lexington, NC (US); Roger Warren, Claremont, NC (US); Gary Ray Cagle, Summerfield, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 907 days.

(21) Appl. No.: 10/877,447

(22) Filed: Jun. 25, 2004

(65) Prior Publication Data

US 2005/0079795 A1 Apr. 14, 2005

Related U.S. Application Data

(60) Provisional application No. 60/483,280, filed on Jun. 27, 2003.

(51) Int. Cl.
*A41C 5/00* (2006.01)
*D04B 1/24* (2006.01)

(52) U.S. Cl. ..... 450/92; 450/93; 66/171; 2/243.1

(58) Field of Classification Search ..... 450/1, 450/65, 66, 79, 82, 92, 93, 58, 41, 45–49, 450/51, 52; 2/243.1, 67, 69, 73, 105, 106, 2/113–115; 66/171, 176, 177, 153, 172 E, 66/170, 169 R, 172 R, 173, 175
See application file for complete search history.

(56) References Cited

U.S. PATENT DOCUMENTS

| | | | | |
|---|---|---|---|---|
| 1,328,586 | A | 1/1920 | Olson | |
| 1,431,206 | A | 10/1922 | Yurka | |
| 1,724,728 | A | 8/1929 | Rothman | |
| 2,013,110 | A | 9/1935 | Rosenthal | 66/176 |
| 2,352,866 | A | 7/1944 | Stacy | 2/42 |
| 2,458,696 | A | 1/1949 | Elias | 2/42 |
| 2,498,487 | A | 2/1950 | Elias | 2/42 |
| 3,421,513 | A | 1/1969 | Landau | 128/443 |
| 3,537,279 | A | 11/1970 | Epley | 66/176 |
| 3,704,469 | A | 12/1972 | Levy | 2/67 |
| 3,718,143 | A | 2/1973 | Pagano et al. | 128/499 |
| 3,772,899 | A | 11/1973 | Novi | 66/176 |
| 4,531,525 | A | 7/1985 | Richards | 450/65 |
| 4,583,544 | A | 4/1986 | Flanagan et al. | 128/482 |
| 4,617,934 | A | 10/1986 | Hittel | 128/425 |
| 4,909,771 | A | 3/1990 | Bergman | 450/3 |
| 5,120,264 | A | 6/1992 | Van Engel | 450/7 |

(Continued)

FOREIGN PATENT DOCUMENTS

| | | |
|---|---|---|
| DE | 1920125 | 4/1969 |

(Continued)

*Primary Examiner*—Gloria Hale
(74) *Attorney, Agent, or Firm*—Womble Carlyle Sandridge & Rice, PLLC

(57) ABSTRACT

A circular knit garment blank is provided. The blank has an internal dimension defined by a series of courses, a length defined by a series of wales, and a first cut line. The length is sufficient to encircle a torso of a wearer. The first cut line is defined in the blank for severing the series of courses along the length.

11 Claims, 3 Drawing Sheets

U.S. PATENT DOCUMENTS

| | | | | |
|---|---|---|---|---|
| 5,162,015 | A | 11/1992 | Otani | 450/7 |
| 5,269,720 | A | 12/1993 | Moretz et al. | 450/7 |
| 5,385,502 | A | 1/1995 | Moretz et al. | 450/37 |
| 5,439,409 | A | 8/1995 | McCracken et al. | 450/31 |
| D366,351 | S | 1/1996 | Winchell | D2/706 |
| 5,479,791 | A | 1/1996 | Osborne | 66/171 |
| 5,553,468 | A * | 9/1996 | Osborne | 66/171 |
| 5,553,486 | A | 9/1996 | Osborne | 66/171 |
| 5,592,836 | A | 1/1997 | Schuster et al. | 66/176 |
| 5,605,060 | A * | 2/1997 | Osborne | 66/171 |
| 5,850,745 | A | 12/1998 | Albright | 66/17 |
| 5,944,579 | A | 8/1999 | Fleischman | 450/69 |
| 5,946,944 | A | 9/1999 | Osborne | 66/176 |
| 6,015,331 | A | 1/2000 | Ioakim | 450/93 |
| 6,082,145 | A | 7/2000 | Lonati et al. | 66/176 |
| 6,125,664 | A | 10/2000 | Browder, Jr. | 66/176 |
| 6,178,784 | B1 | 1/2001 | Marley, Jr. | 450/75 |
| 6,192,717 | B1 | 2/2001 | Rabinowicz | 66/177 |
| 6,276,175 | B1 | 8/2001 | Browder, Jr. | 66/171 |
| 6,287,168 | B1 | 9/2001 | Rabinowicz | 450/75 |
| 6,550,286 | B2 | 4/2003 | Querquant | 66/176 |
| 6,779,367 | B2 * | 8/2004 | Mitchell et al. | 66/176 |
| 6,817,214 | B2 * | 11/2004 | Rabinowicz et al. | 66/176 |
| 2002/0155786 | A1 | 10/2002 | Querquant | 450/93 |
| 2003/0171066 | A1 | 9/2003 | Mitchell et al. | 450/66 |
| 2003/0230120 | A1 | 12/2003 | Mitchell et al. | 66/171 |

FOREIGN PATENT DOCUMENTS

| | | |
|---|---|---|
| GB | 2 291 782 A | 2/1996 |
| MX | 94092 | 3/1994 |
| MX | 94311 | 9/1994 |
| MX | 9500770 | 8/1995 |
| MX | 9600206 | 5/1996 |
| MX | 192057 | 6/1996 |
| MX | 9602390 | 6/1996 |
| MX | 9602840 | 7/1996 |
| MX | PA/U/1997/000061 | 2/1997 |
| MX | PA/U/1998/000084 | 3/1998 |
| MX | PA/U/1998/000334 | 11/1998 |
| MX | PA/U/1999000163 | 6/1999 |
| MX | 9800084 | 7/2001 |

* cited by examiner

GARMENT BLANKS, BRASSIERES FORMED THEREFROM AND METHOD OF FORMING THE SAME

CROSS-REFERENCE TO RELATED APPLICATIONS

This application claims the benefit of U.S. Provisional Application Ser. No. 60/483,280, filed Jun. 27, 2003, now abandoned, the contents of which are incorporated by reference herein. In addition, this application is related to U.S. application Ser. No. 10/406,789 filed on Apr. 3, 2003, which issued as U.S. Pat. No. 6,863,589, the contents of which are incorporated by reference herein in their entirety.

BACKGROUND OF THE INVENTION

1. Field of the Invention

The present invention relates to garments blanks. More particularly, the present invention relates to garment blanks, brassieres formed therefrom, and methods of forming such blanks and brassieres.

2. Description of Related Art

A brassiere is used to support the breasts of the wearer. A brassiere typically has a portion that wraps around the upper torso of the wearer. The portion includes breast receiving areas for receiving the breasts of the wearer. The receiving areas can include breast cups so that the wearer's breasts are received in and supported by the breast cups.

Brassieres can also include other components such as an underwire or other supporting structure along the lower periphery of the breast cups. The underwire can aid in supporting the wearer's breasts. Brassieres can also have one or more shoulder straps connected to the body-encircling portion. The straps can transfer at least a portion of the support function to the wearer's shoulders.

It can be desired to minimize the number of seams and other garment discontinuities in undergarments. Seams and garment discontinuities can be physically and/or aesthetically unpleasing. For example, seams in a brassiere can chaff, exert pressure points and, thus, can be a source of physical discomfort. In addition, seams in a brassiere or an undergarment can often be visible through outer clothing, which normally is aesthetically unpleasing.

Accordingly, there is a need for a substantially seamless brassiere that is easy to manufacture and assemble.

BRIEF SUMMARY OF THE INVENTION

It is an object of the present invention to provide a garment blank for making a substantially seamless brassiere.

It is another object to provide a simple, easy to manufacture brassiere.

It is still a further object of the present invention to provide a brassiere made from a tubular blank.

It is yet another object to provide simple methods of making substantially seamless two-layer brassiere.

These and other aspects and advantages of the present invention are provided by a circular knit garment blank. The blank has an internal dimension defined by a series of courses, a length defined by a series of wales, and a first cut line. The length is sufficient to encircle a torso of a wearer. The first cut line is defined in the blank for severing the series of courses along the length.

These and other aspects and advantages of the present invention are also provided by a two-layer brassiere. The brassiere includes a weft knit fabric having a series of courses and a series of wales. The series of courses define an internal dimension, while the series of wales define a length. The length is sufficient to encircle a torso of a wearer. The brassiere also includes a cut line where the series of courses along at least a portion of the length have been severed and a seam joining the series of courses along the cut line.

Further aspects and advantages of the present invention are provided by a method of forming a brassiere. The method includes circularly knitting a tubular blank having a first side exterior to the tubular blank; applying one or more brassiere components to the first side; and turning the blank inside out so that the first side and the one or more brassiere components are interior to the tubular blank. The tubular blank has an internal dimension defined by a series of courses and a length defined by a series of wales, where the length is sufficient to encircle a torso of a wearer.

The above-described and other features and advantages of the present invention will be appreciated and understood by those skilled in the art from the following detailed description, drawings, and appended claims.

DETAILED DESCRIPTION OF THE INVENTION

Figure 1:
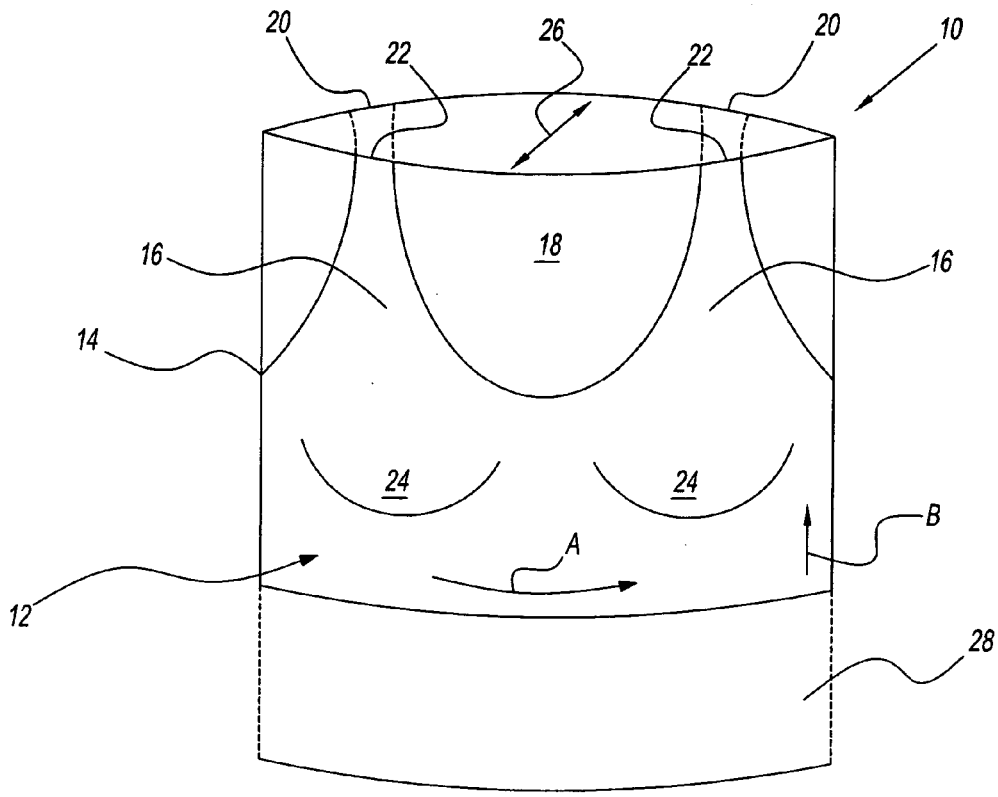
FIG. 1 is a perspective view of a prior art brassiere formed from a cylindrically knit garment blank.

Referring now to the drawings and in particular to FIG. 1, a prior art brassiere is generally represented by reference numeral 10. Brassiere 10 is formed from a cylindrically knit garment blank 12.

Blank 12 is formed by a circular or weft knitting process, such as one that has found wide use in the production of a variety of clothing items, such as a pair of pantyhose, a sock, a pair of stockings, a brassiere, a blouse, a leotard, a swimsuit, a pair of panties, a pair of men's underwear, and other garments or apparel. Blank 12 can be manufactured by commercially available equipment, such as the SANTONI HFVM or HF4.7 knitting machines, or other circular knitting machines. During the circular knitting process, blank 12 is knitted about a rotating machine cylinder to define a series of courses A in the knit direction and a series of wales B, which are perpendicular to the knit direction.

In some prior brassieres 10, blank 12 was trimmed along a cut line 14 to define a pair of shoulder straps 16 and a neck opening 18. Each strap 16 defines a pair of edges 20 and 22 that are joined to one another to complete brassiere 10.

Brassiere 10 can have a pair of breast receiving areas 24. Areas 24 can include breast cups formed by, for example, a known cup molding process, a known knitting process, and other known processes. Alternately, brassiere 10 can be a bandeau style brassiere, which lacks breast cups in breast receiving areas 24.

Accordingly, brassiere 10 includes a seam (not shown) where edge 20 meets edge 22. Unfortunately, these seams are present at a high pressure point, leading to physical discomfort for the wearer. In these prior art brassieres 10, cylindrical blank 12 had an internal dimension 26 sufficient in size to be received over the torso of the wearer. Specifically, internal dimension 26 is defined by the dimension of courses A.

Often times, it has been desired to provide brassiere 10 with more than one layer of fabric. In these instances, blank 12 has included a second layer 28 extending therefrom as illustrated in phantom. Blank 12 can be folded about one of the series of wales B so that second layer 28 can form an inner or an outer ply of brassiere 10.

The equipment that manufactures cylindrical blank 12 with internal dimension 26 sufficient to be received over the torso of the wearer is often very expensive. For example, the equipment requires a knitting cylinder of sufficient size to knit courses A having internal dimension 26. Moreover, this equipment oftentimes can not be used to manufacture garments having smaller internal dimensions.

However, circular-knitting equipment that can manufacture a cylindrical blank with an internal dimension sufficient in size for smaller products, such as hosiery products, is commonplace around the world. These smaller dimension cylindrical blanks can be used to make a variety of products, such as a sock, a pair of stockings, a pair of pantyhose, a shirt, and others.

Figure 2:
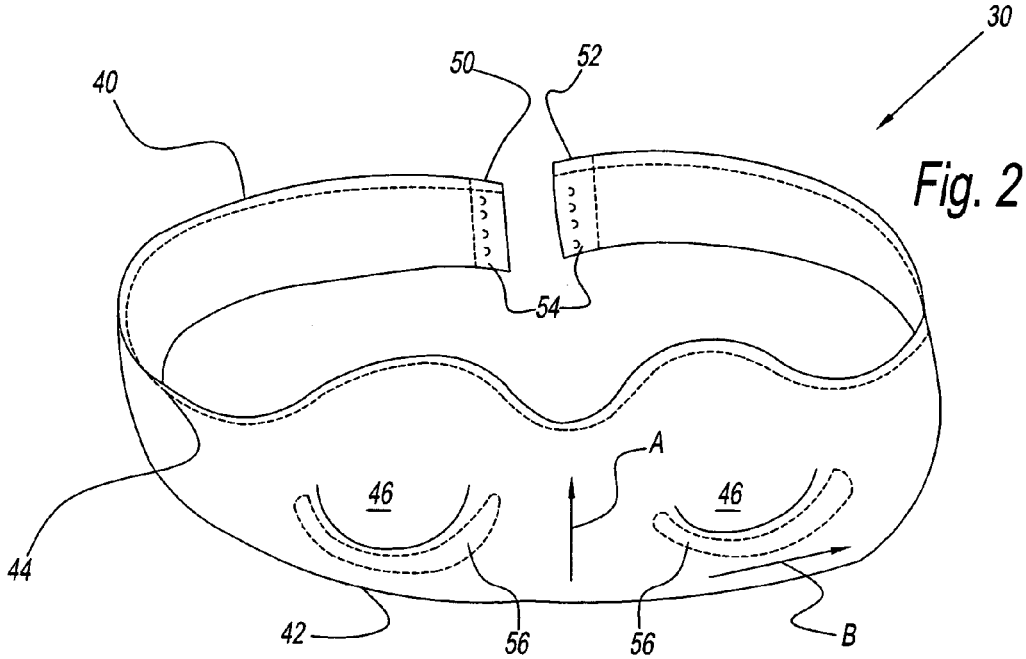
FIG. 2 is a perspective view of a brassiere according to the present invention.
Figure 3:
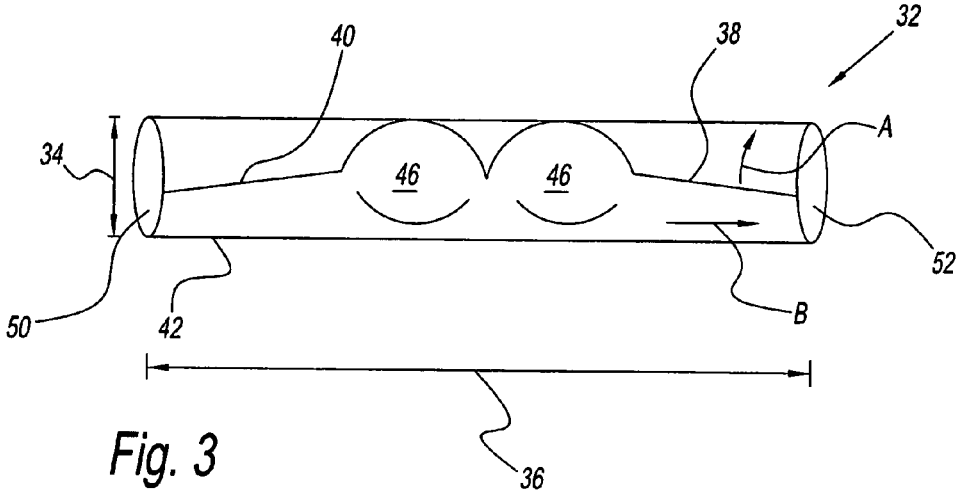
FIG. 3 is a perspective view of an exemplary embodiment of a cylindrically knit garment blank used in the manufacture of the brassiere of FIG. 2.

Referring now to FIGS. 2 and 3, a substantially seamless two-layer brassiere 30 according to the present invention and a cylindrically or weft knit blank 32 used to form the brassiere are illustrated.

Blank 32 is formed of a synthetic material, a natural material, or any combinations thereof. Preferably, blank 32 includes one or more circularly knitable elastic yarns such as, but not limited to, nylon, elastane, and other elastic yarns. Thus, blank 32 is preferably made of elastic materials that can hold brassiere 30 against the body, as well as provide support to the wearer's breasts.

Blank 32 has an internal dimension 34, which is not sufficient to fit over a person's torso. Rather, internal dimension 34 is sufficient to fit over, for example, one leg of a person. Blank 32 can therefore be made using the circular-knitting equipment used for hosiery products. Specifically, blank 32 is knitted to define a series of courses A in the knit direction and a series of wales B, which are perpendicular to the knit direction. In a preferred embodiment, internal dimension 34 is substantially constant along length 36.

Blank 32, and brassiere 30 defined therein, has a desired length 36, which is, preferably, sufficient to wrap around a person's torso. Thus, internal dimension 34 is defined by courses A, while length 36 is defined by wales B.

Brassiere 30 can be defined in blank 32 by way of a cut line 38 disposed along an upper edge 40 of the brassiere. Blank 32 is severed along cut line 38 to define brassiere therefrom. Specifically, at least some of courses A are severed along at least a portion of length 36.

Prior to severing, cut line 38 can be a visible line defined on blank 32 after knitting. Here, brassiere 30 can be separated from blank 32 by cutting the blank along cut line 38. Alternately, cut line 38 can be a visible line or pattern knit into blank 32. For example, blank 32 can include a heat fusible yarn (not shown) knit therein to define cut line 38. Here, brassiere 30 can be separated from blank 32 during a heating process sufficient to melt the yarn.

Brassiere 30 also includes a seam 44 at cut line 38. Seam 44 can be formed by way of sewing, adhesives, ultrasonic fusing, and other joining methods. Seam 44 is defined along length 36 of brassiere 30 (i.e., along wales B). Seam 44 rejoins blank 32 to itself in the area of cut line 38 by joining the series of courses A severed along the cut line. Prior to cutting along cut line 38, blank 32 is a cylindrical tube. However, cutting blank 32 along cut line 38 causes one or more series of courses A along the cut line to separate from one another.

Seam 44 rejoins blank 32 to itself in the area of cut line 38. In this manner, blank 32 can be used to define brassiere 30, which is a two-layer brassiere. In one embodiment, blank 32 is folded flat such that seam 44 is disposed at upper edge 40. Here, brassiere 30 is a substantially seamless bra, which includes seam 44 only along upper edge 40.

Upper edge 40 is not a load bearing portion of the garment and, thus, does not exert pressure on the user. Thus, it has been found that providing seam 44 at upper edge 40 can mitigate and/or eliminate the chaffing and pressure points caused by seams in other locations on brassiere 30 that allow the seam to exert pressure on the user. It has also been found that providing seam 44 at upper edge 40 can mitigate and/or eliminate the visibility of the seam through outer clothing. Thus, brassiere 30 having seam 44 along upper edge 40 can be more comfortable and aesthetically pleasing than previous garments.

It should be recognized that brassiere 30 is illustrated by way of example as having cut line 38 and, thus, seam 44 disposed at upper edge 40. Of course, it is contemplated by the present invention for brassiere 30 to have cut line 38 and seam 44 disposed at a lower edge 42. Similar to upper edge 40 discussed above, lower edge 42 is not a load bearing portion of the garment and, thus, does not exert pressure on the user.

Cut line 38 is illustrated as being continuous along upper edge 40. However, it is also contemplated for cut line 38 to be discontinuous across upper edge 40. In this embodiment, at least a portion of upper edge 40 is defined by an uncut portion of blank 32.

Brassiere 30 can include a pair of breast receiving areas 46. Areas 46 can include breast cups having a knitted cup depth, which is a common technique used in hosiery blank manufacture for the heel of the wearer. Alternately, areas 46 can have cups having a molded cup depth by molding the breast receiving areas of blank 32 in any known manner. In other embodiments, brassiere 30 can be a bandeau style brassiere, which lacks breast cups in the breast receiving areas 46.

Preferably, cut line 38 provides at least a portion of upper edge 40 with a shaped appearance. The shaped appearance results from cut line 38 varying internal dimension 34 along length 36. For example, blank 32 can be trimmed along cut line 38 so that inner dimension 34 is larger in the region of breast receiving areas 46, which provides upper edge 40 with its shaped appearance. In a preferred embodiment, the portion of upper edge 40 proximate breast receiving areas 46 by an uncut portion of blank 32.

Blank 32 defines a first end 50 and a second end 52, which provide access to internal dimension 34. Thus, blank 32 allows one or more brassiere components to be inserted in inner dimension 34 of the blank through ends 50, 52. By way of example, the brassiere components can include a fastener 54, an underwire 56, and other brassiere components.

Fastener 54 can enable the wearer to easily fasten/unfasten brassiere 30 from their body. Here, fastener 54 can also be used to seal or close ends 50, 52. Fastener 54 can include "hook and eye" type connectors as illustrated, a zipper, a snap, a "hook-tape" strip (e.g., VELCRO), and other fasteners.

It should be recognized that fasteners 54 are described above by way of example as being positioned in brassiere 30 diametrically opposite breast cups 46 (e.g., a rear closure). Of course, it is contemplated by the present invention for fasteners 54 to be positioned between breast cups 46 (e.g., a front closure). Further, fasteners 54 can be positioned at any desired position along length 36 (e.g., a side closure).

Alternately, brassiere 30 can have first and second ends 50, 52 joined together by way of a seam (not shown). In this embodiment, the wearer can pull brassiere 30 into place over their body.

In addition, underwire 56 can be disposed in inner dimension 34 through ends 50, 52 prior to sealing the ends. Underwire 56 can aid in support of the breasts of the wearer.

Accordingly, brassiere 30 of the present disclosure is substantially seamless (e.g., seam 44), has two layers, and can be easily manufactured from very few components in very few process steps. Moreover, brassiere 30 can be manufactured from cylindrical hosiery blanks 32 that are readily available.

Figure 4:
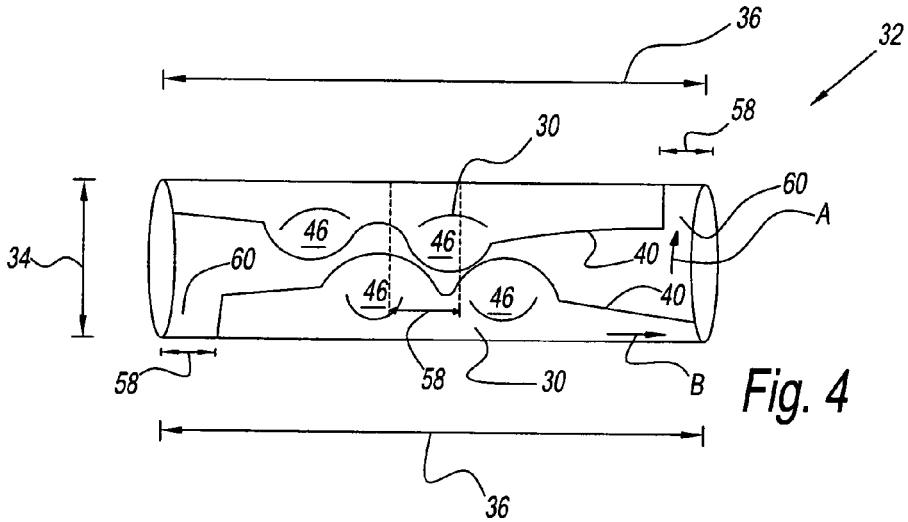
FIG. 4 is a perspective view of an alternate exemplary embodiment of the cylindrically knit garment blank of FIG. 3.

Referring now to FIG. 4, an alternate exemplary embodiment of blank 32 used in the simultaneous manufacture of two brassieres 30 is illustrated.

Blank 32 is, preferably, a hosiery blank and has an internal dimension 34 sufficient in size to form two brassieres 30. Specifically, blank 32 includes two brassieres 30 defined therein by a pair of cut lines 38. Cut lines 38 are disposed at an upper edge 40 of each brassiere 30. Thus, brassieres 30 are defined in blank 32 so that their upper edges 40 are proximate one another.

In addition, brassieres 30 are offset from one another by a predetermined distance 58. Distance 58 is sufficient to nest the profile of breast areas 46 in upper edge 40 in one another. It has been found that nesting the profile of breast cups 46 allows internal dimension 34 to be minimized.

Brassiere 30 also has a desired length 36, which is, preferably, sufficient to wrap around a person's torso. Thus, blank 32 is long enough to provide length 36 of brassiere 30 and a portion 60 sufficient to compensate for the offset of brassieres 30 with respect to one another by distance 58.

In this manner, each blank 32 can provide two substantially seamless, two-layer brassieres 30 that can be easily manufactured from very few components in very few process steps. Moreover, brassiere 30 can be manufactured from cylindrical hosiery blanks 32 that are readily available.

Figure 5:
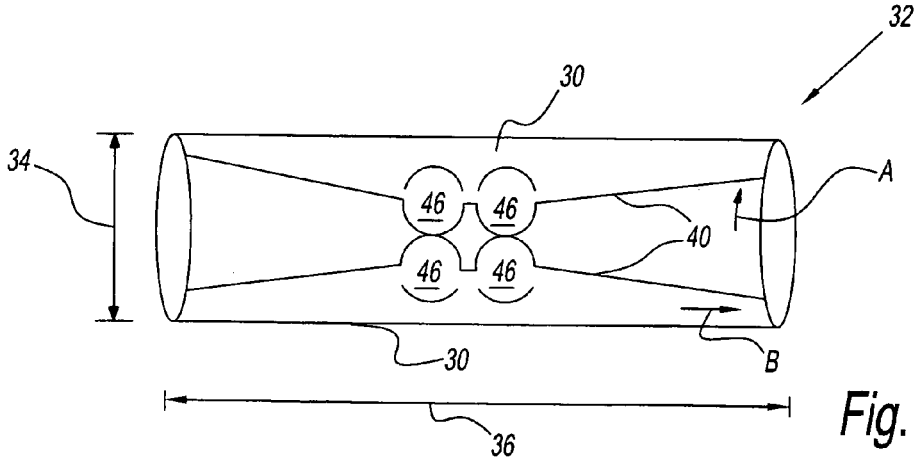
FIG. 5 is a perspective view of another alternate exemplary embodiment of the cylindrically knit garment blank of FIG. 3.

Referring now to FIG. 5, another alternate exemplary embodiment of blank 32 used in the simultaneous manufacture of two brassieres 30 is illustrated.

Again, blank 32 has an internal dimension 34 sufficient in size to form two brassieres 30 defined therein by a pair of cut lines 38. Cut lines 38 are disposed at an upper edge 40 of each brassiere 30. Thus, brassieres 30 are defined in blank 32 so that their upper edges 40 are proximate one another.

Here, brassieres 30 are disposed as mirror images of one another in blank 32. Thus, blank 32, and brassieres 30 defined therein, have a desired length 36, which is, preferably, sufficient to wrap around a person's torso.

An exemplary embodiment of a method 62 of forming brassiere 30 is illustrated in FIGS. 6 through 9. It has been found that one or more brassiere components (e.g., underwire 56) can be difficult to insert into internal dimension 34. Advantageously, method 62 eliminates the need to insert the brassiere components into internal dimension 34. Rather, method 62 applies the brassiere components to the exterior face of the blank. After application of the brassiere components, blank 32 is turned inside out so that the brassiere components are in internal dimension 34.

Figure 6:
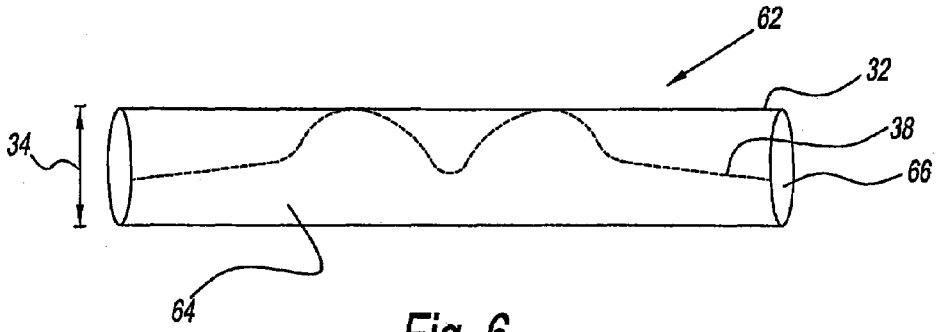
FIGS. 6 through 9 illustrate an alternate embodiment of a method of forming the brassiere of FIG. 2.
Figure 7:
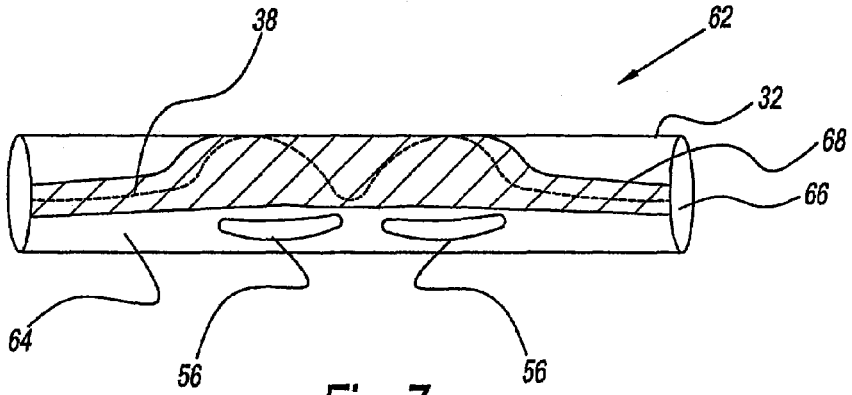

Specifically, blank 32 is illustrated in FIG. 6 having a first side 64 and a second side 66. Here, first side 64 is at the exterior of blank 32 and second side 66 inside of the blank. Next, the selected brassiere components are applied to first side 64. For example, blank 32 is illustrated having underwire 56 and an adhesive 68 applied to first side 64 in FIG. 7.

Figure 8:
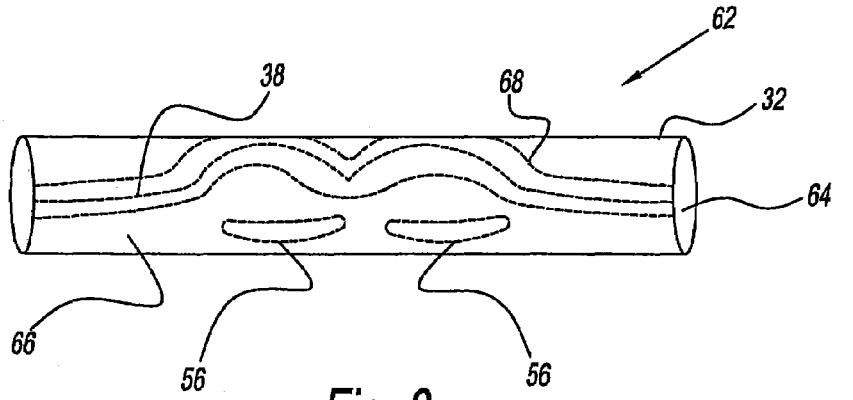
Figure 9:
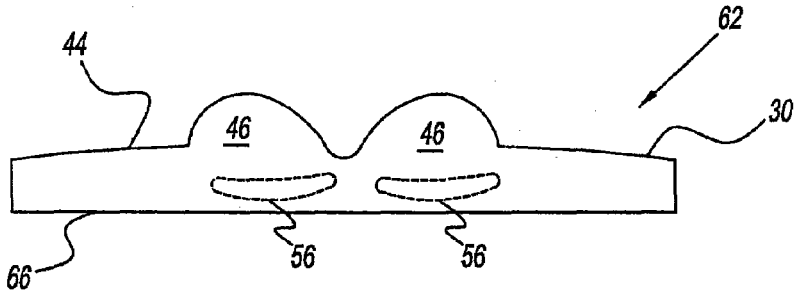

Once the selected brassiere components are positioned on first side 64, blank 32 is turned inside out as seen in FIG. 8. Thus, blank 32 is repositioned so that first side 64 is now inside of the blank and second side 66 is exterior of the blank. Thus, the selected brassiere components are now in internal dimension 34. Finally, blank 32 can be trimmed and seamed to form brassiere 30 as seen in FIG. 9.

For example, it is contemplated to simultaneously apply heat and pressure to blank 32 to activate adhesive 68, while trimming the blank along cut line 38. In addition, it is contemplated for method 62 to simultaneously mold breast receiving areas 46 in blank 32 during the aforementioned heat and pressure application.

Method 62 is illustrated for purposes of clarity having underwire 56 and adhesive 68 applied to first side 64. Of course, it is contemplated by the present disclosure for additional brassiere components and/or other brassiere components to be applied. For example, in one embodiment blank 32 is ultrasonically sealed along cut line 38 and, thus, lacks adhesive 68.

It should also be recognized that method 62 is illustrated by way of example having adhesive 68 applied only at cut line 38, namely the adhesive is applied only in the area of seam 44. Of course, it is contemplated by the present disclosure for adhesive 68 to applied to other areas of blank 32, such as on all of first side 64, on all of the first side but breast receiving areas 46 of brassiere 30, and others.

The terms "first", "second", "third", "upper", "lower", and the like may be used herein to modify various elements. These modifiers do not imply a spatial, sequential, or hierarchical order to the modified elements unless specifically stated.

While the present invention has been described with reference to one or more exemplary embodiments, it will be understood by those skilled in the art that various modifications may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention.

What is claimed is:

1. A two-layer strapless brassiere comprising:

a weft knit fabric folded flat to form two layers;

a brassiere height defined by a series of courses terminating in a cut line;

a length defined by a series of wales, said length dimensioned to encircle a torso of a wearer; and a seam formed along said cut line, the cut line defining a pair of breast receiving areas and a torso encircling strap extending outwardly along the length of the fabric from each of the pair of breast receiving areas.

2. The brassiere as in claim 1, wherein said seam is selected from the group consisting of a sewn seam, an adhesive seam, and a ultrasonically fused seam.

3. The brassiere as in claim 1, further comprising a pair of breast cups defined in said breast receiving areas.

4. The brassiere as in claim 3, wherein said pair of breast cups have a knitted cup depth.

5. The brassiere as in claim 1, wherein said cut line is defined along substantially the entirety of said length.

6. A method of forming a brassiere, comprising:

circularly knitting a tubular blank having a first side exterior to said tubular blank, said tubular blank having a height when then folded flat to form two layers, the height defined by a series of courses, and a length defined by a series of wales, said length dimensioned to encircle a torso of a wearer;

applying one or more brassiere components to said first side;

turning said blank inside out so that said first side and said one or more brassiere components are interior to said tubular blank;

trimming the tubular blank along a lengthwise cut line to define a pair of breast receiving areas and a torso encircling strap extending outwardly along the length of the fabric from each of the pair of breast receiving areas; and forming a seam along the cut line.

7. The method as in claim 6, wherein said one or more brassiere components comprises an underwire.

8. The method as in claim 6, further comprising adhering said tubular blank along said cut line with a heat activatable adhesive.

9. The method as in claim 8, further comprising molding a pair of breast cups in said tubular blank.

10. The method as in claim 9, wherein trimming, adhering, and molding steps comprise simultaneously applying heat and pressure to said tubular blank.

11. A method of forming a brassiere, comprising:

circularly knitting a tubular blank, the tubular blank having a height when then folded flat to form two layers, the height defined by a series of courses, and a length defined by a series of wales, the length dimensioned to encircle a torso of a wearer;

trimming the tubular blank along a cut line to define a pair of breast receiving areas and a torso encircling strap extending outwardly along lengthwise the length of the fabric from each of the pair of breast receiving areas; and forming a seam along the cut line to form a brassiere.

* * * * *